US009133860B2

(12) United States Patent
Kloft et al.

(10) Patent No.: US 9,133,860 B2
(45) Date of Patent: Sep. 15, 2015

(54) PRESSURE VESSEL

(75) Inventors: Peter Kloft, Ranabach-Baumbach (DE); Herbert Baltes, Losheim (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 0 days.

(21) Appl. No.: 13/261,790

(22) PCT Filed: Aug. 1, 2012

(86) PCT No.: PCT/EP2012/003264

§ 371 (c)(1),
(2), (4) Date: Dec. 11, 2013

(87) PCT Pub. No.: WO2013/026521

PCT Pub. Date: Feb. 28, 2013

(65) Prior Publication Data

US 2014/0190965 A1 Jul. 10, 2014

(30) Foreign Application Priority Data

Aug. 19, 2011 (DE) ..... 10 2011 111 098

(51) Int. Cl.
*F15B 1/16* (2006.01)

(52) U.S. Cl.
CPC . *F15B 1/16* (2013.01); *F15B 1/165* (2013.01); *F15B 2201/20* (2013.01); *F15B 2201/3152* (2013.01); *F15B 2201/405* (2013.01); *F15B 2201/4053* (2013.01); *F15B 2201/605* (2013.01); *F17C 2201/018* (2013.01); *F17C 2201/0109* (2013.01); *F17C 2201/056* (2013.01); *F17C 2203/0604* (2013.01); *F17C 2203/066* (2013.01); *F17C 2203/0619* (2013.01); *F17C 2203/0663* (2013.01); *F17C 2203/0675* (2013.01); *F17C 2205/0397* (2013.01); *F17C 2209/2127* (2013.01); *F17C 2209/221* (2013.01); *F17C 2209/234* (2013.01); *F17C 2270/0554* (2013.01)

(58) Field of Classification Search
CPC ..... F15B 2201/40; F15B 2201/456; F15B 1/165; F15B 1/04
USPC ..... 220/581, 586, 588, 589, 590, 591
See application file for complete search history.

(56) References Cited

U.S. PATENT DOCUMENTS

| | | | | |
|---|---|---|---|---|
| 1,484,056 | A * | 2/1924 | Birtch | 220/694.1 |
| 3,557,827 | A * | 1/1971 | Marsh | 137/590 |
| 7,195,133 | B1 | 3/2007 | Cundiff et al. | |
| 7,322,487 | B1 * | 1/2008 | Hill et al. | 220/581 |
| 2003/0019874 | A1 * | 1/2003 | Wright et al. | 220/589 |
| 2003/0111473 | A1 * | 6/2003 | Carter et al. | 220/586 |
| 2007/0125789 | A1 * | 6/2007 | Abdo | 220/694 |

(Continued)

FOREIGN PATENT DOCUMENTS

| | | |
|---|---|---|
| DE | 2 153 899 A1 | 5/1972 |
| DE | 31 25 497 A1 | 5/1982 |

(Continued)

*Primary Examiner* — Anthony Stashick
*Assistant Examiner* — Mollie Llewellyn
(74) *Attorney, Agent, or Firm* — Roylance, Abrams, Berdo & Goodman LLP

(57) ABSTRACT

A pressure vessel, provided preferably for use in bladder accumulators (27), has a multipart vessel body (1) composed of a tubular central part (3) that at at least one of its two ends, has a termination region (5, 7). A cover part (9) at least partially forms the termination region (5, 7) and engages at the edge over the central part (3), at least in the region of its end (13, 15), so as to form a fixed connection.

16 Claims, 3 Drawing Sheets

(56) References Cited

U.S. PATENT DOCUMENTS

| | | | | |
|---|---|---|---|---|
| 2009/0107570 | A1* | 4/2009 | Weber | 138/30 |
| 2010/0071792 | A1* | 3/2010 | Baltes et al. | 138/30 |
| 2012/0000916 | A1* | 1/2012 | Kleber et al. | 220/590 |

FOREIGN PATENT DOCUMENTS

| | | | |
|---|---|---|---|
| DE | 602 07 082 | T2 | 6/2006 |
| DE | 10 2006 004 120 | A1 | 7/2007 |
| FR | 2 828 265 | A1 | 2/2003 |
| JP | 6-6701 | U | 1/1994 |
| JP | H06 61701 | U | 1/1994 |
| JP | 6 033901 | A | 2/1994 |
| WO | WO 97/28401 | A1 | 8/1997 |
| WO | WO 2005/093313 | A1 | 10/2005 |
| WO | WO 2010/040040 | A1 | 4/2010 |

* cited by examiner

PRESSURE VESSEL

FIELD OF THE INVENTION

The invention relates to a pressure vessel, preferably provided for use in bladder accumulators, having a multipart vessel body. The body has a tubular central part having a termination region on at least one of its ends. The invention also relates to a bladder accumulator having that multipart vessel body.

BACKGROUND OF THE INVENTION

State-of-the-art pressure accumulators have multipart vessel bodies for storage of liquid and/or gaseous media under pressure. For example, WO 2007/085276 A1 discloses a pressure vessel in which the multipart vessel body is constructed of a first plastic shell and a second plastic shell encompassing the first plastic shell. The first plastic shell forming the vessel core is preferably made of polyamide and is formed by a blow molding process. The first shell is reinforced on the outer circumference by a fiber wrapping as a second plastic shell wound onto it from the outside. The reinforced winding is formed of a fiber reinforcement, such as carbon fibers, aramit fibers, glass fibers, drilling fibers, $Al_2O_3$ fibers or mixtures thereof, and is embedded in a basic matrix of thermosetting plastics, for example, epoxy resins or phenolic resins or in thermoplastics, for example, in the form of PA12, PA6, PP, etc.

Such pressure vessels made of plastic are characterized by a low structural weight and an extensive insensitivity to negative effects due to corrosive media contacting their inside and/or outside. These advantages require a corresponding manufacturing complexity.

SUMMARY OF THE INVENTION

An object of the invention is to provide an improved pressure vessel that can be manufactured comparatively more easily and more economically, while retaining the low structural weight and insensitivity to corrosive media.

According to the invention, this object is basically achieved by a pressure vessel having a cover part, forming at least partially the respective vessel end region, that extends onto the central part only in the region of its respectively allocable end, while forming a fixed joint at the edges. This structure opens up the advantageous possibility of designing a pressure-tight vessel in a lightweight design, in which multiple different plastic shells need no longer be arranged one above the other as in the prior art. Instead, manufacture is sufficient when the termination region of a central part of the pressure vessel that is of interest is closed by the cover part. In addition to a simple structural design, which can be manufactured economically and inexpensively to this extent, the approach according to the pressure vessel according to the invention, with regard to maintaining pressure strength values, has no disadvantages in comparison with the complex approaches in the prior art.

In a preferred embodiment of the pressure vessel according to the invention, a cap can be provided as an additional component of the respective termination region. This cap is connected to the respective pipe end of the central part to be allocated thereto. The cover part is designed in the manner of a cover laminate extending at least partially beyond the respective cap. To this extent, the possibility exists of providing the tubular central part with an end cap in addition to the cover laminate in the region of its two free ends, so that to this extent one obtains better sealing results and greater strength values than if the free ends of the central part were to be terminated directly with the cover parts to be shaped like a hollow cap, but omitting the caps directly.

Preferably, the tubular central part, like the respectively cap, is to be made of a fiber composite material and/or from a laminate of fibers, preferably a glass fiber-reinforced plastic material (GRP). Additional materials that may be used include aramid fibers, carbon fibers or combinations of these materials. Preferably, standard tubes made of GRP for the central part may be used such as those manufactured in large quantities by the wrapping process for conventional plant manufacturing and freely obtainable on the market. Such pipes are obtained inexpensively, with and without a chemical-resistant layer, thereby permitting an adaptation of the pressure vessel according to the invention to the respective fields of application, even for applications involving particularly aggressive chemical media. Such pipes are constructed of glass fiber-reinforced vinyl ester resin, for example, and the caps for the end of the central part are preferably manufactured by manual lamination methods and may be constructed of comparable plastic materials as well as the respective cover laminate, which laminate terminates the composite of the cap and central part with a seal to the outside.

In a particularly preferred embodiment, the pressure vessel according to the invention has a respective cap designed in the form of a hemisphere having at least one opening uncovered by the cover laminate for introducing a corresponding pressure medium. The design of the respective cap as a hemisphere has proven favorable for the introduction of pressures and pressure peaks into the vessel material of the pressure vessel. The pressure vessel need not be constructed entirely of plastic materials. The possibility always exists of also forming the central part of a cast metal material and forming one of the end caps as the termination region of the vessel that is then to be connected in a pressure-tight manner to the central part by a conventional welding method. On the other hand, the other end of the central part can then be sealed with the termination region designed according to the invention using a plastic cover laminate and/or a plastic cap. A lightweight design of the pressure vessel as a whole can then also be achieved to this extent.

To be able to make pressure vessels designed in this way available for the widest possible range of applications, a modular design of the pressure vessel with its components is preferably provided. That modular design also includes constructing the central part from individual pipe parts, optionally subdivided into multiple segments. The pipe segments of the central part, for example, are fixedly connectable to one another by adhesive joints.

The arrangement may advantageously be such that the caps are glued to the respective pipe ends, for example, by a multicomponent adhesive and then permanently joined to the pipe by the cover laminate.

Such design is also characterized by a secure operating behavior because the failure of such components is to be classified as non-dangerous, and because so-called "weeping" occurs at an excessive internal pressure, in which the vessel simply becomes leaky like a porous tube. This behavior is based on the effect that, in an overload, multiple resin fractures always occur in the laminate (interfiber fractures), which fractures ultimately lead to leaking, with a corresponding reduction in the overload without resulting in any threat to the environment.

The cover laminate preferably extends beyond the connecting site between the cap and the pipe end over a region of the adjacent pipe beyond the central part to thereby achieve a secure attachment of the cover laminate to the central part. To be able to absorb high compressive forces in the interior of the pressure vessel, the cover laminate, which laminate can be manufactured particularly preferably by the manual lamination method on the actual vessel housing, is preferably designed to be thicker and/or more compact in the direction of the uncovered opening for the passage of the respective pressure medium from the application of material.

In a particularly preferred embodiment of the pressure vessel according to the invention, the central part is to be covered completely by two opposing cover laminates by joining the two neighboring ends of the two cover laminates to one another in a pressure-tight manner. In that case, the central part of a plastic material becomes a type of liner, so that the vessel body according to the invention can readily be used even in the high pressure range (>25 bar).

However, the vessel bodies according to the invention are pressure-tight, at least in the low pressure range (<25 bar), without an additional lining in the form of a liner, regardless of the specific design. As an alternative to the vessel approach described above, forming a liner, the inner chamber of the vessel body can be furnished with a liner, preferably in the form of a plastic coating, as a liner applied in the form of a centrifugal sintering or rotational sintering method.

In addition to the resulting higher compressive strength, such liner may also serve as a chemical-resistant layer. For a particularly high compressive strength, the cover laminate could also extend over the entire pipe length of the central part.

To form a bladder accumulator, both caps may have an opening, with one connected to the inner chamber of a accumulator bladder.

The subject matter of the invention also includes a bladder accumulator having a pressure vessel according to the invention and provided for media separation, in particular the separation of water/glycol mixtures from sea water in marine facilities.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
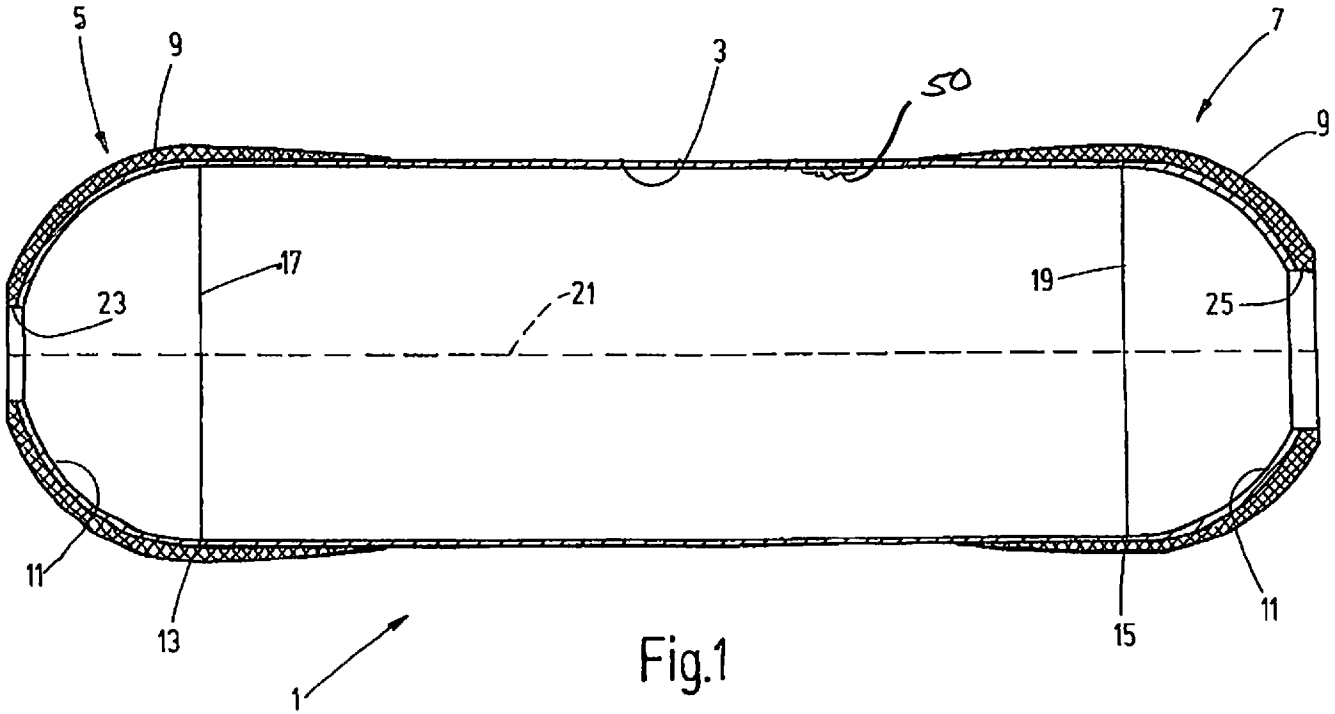
FIG. 1 is a schematic, not to scale, side elevational view of a pressure vessel according to the invention.

In the exemplary embodiments illustrated here, the vessel or pressure body 1 of the pressure vessel is constructed of three main parts, namely a central part in the form of a cylindrical pipe 3, and termination regions 5 and 7 connected to the ends of the pipe 3 forming the central part. The pipe 3 forming the central part is a GRP pipe manufactured by the wrapping method from glass fiber-reinforced vinyl ester resin, for example. Termination regions 5 and 7 have a cover laminate 9 of synthetic resins and reinforcing material surrounding the outside of one cap each. Each cover laminate is connected to the pipe ends 13 and 15, in the exemplary embodiment shown here. The caps 11 are in the form of hemispheres produced in a mold by the manual lamination method. The caps 11 are glued to the pipe ends 13 and 15 by a multicomponent adhesive. As shown in the drawing, the cover laminate 9 is applied such that it extends over the respective connecting line 17 and 19 to the pipe ends 13 and/or 15 over a length preferably approximately one-third to one-fourth of the pipe 3 forming the central part. For a vessel body 1 of a high compressive strength, the cover laminate 9 could be applied over the full length of the pipe 3. The inside surface of the vessel body can have a lining 50 in the form of a plastic liner applied by a centrifugal sintering method or a rotational sintering method.

In the example shown here, the central part 3 is formed from a one-piece pipe 3. As self-evident, more than one pipe may form the central part, with the cover laminate 9 optionally extending over additional connecting lines.

In the example in FIG. 1, media openings 23 and 25 are concentric to the cylinder axis 21, are free of the cover laminate 9 and are provided on both end caps 11. The opening 25 adjacent to the pipe end 15 has a larger diameter than the other opening 23.

Figure 2:
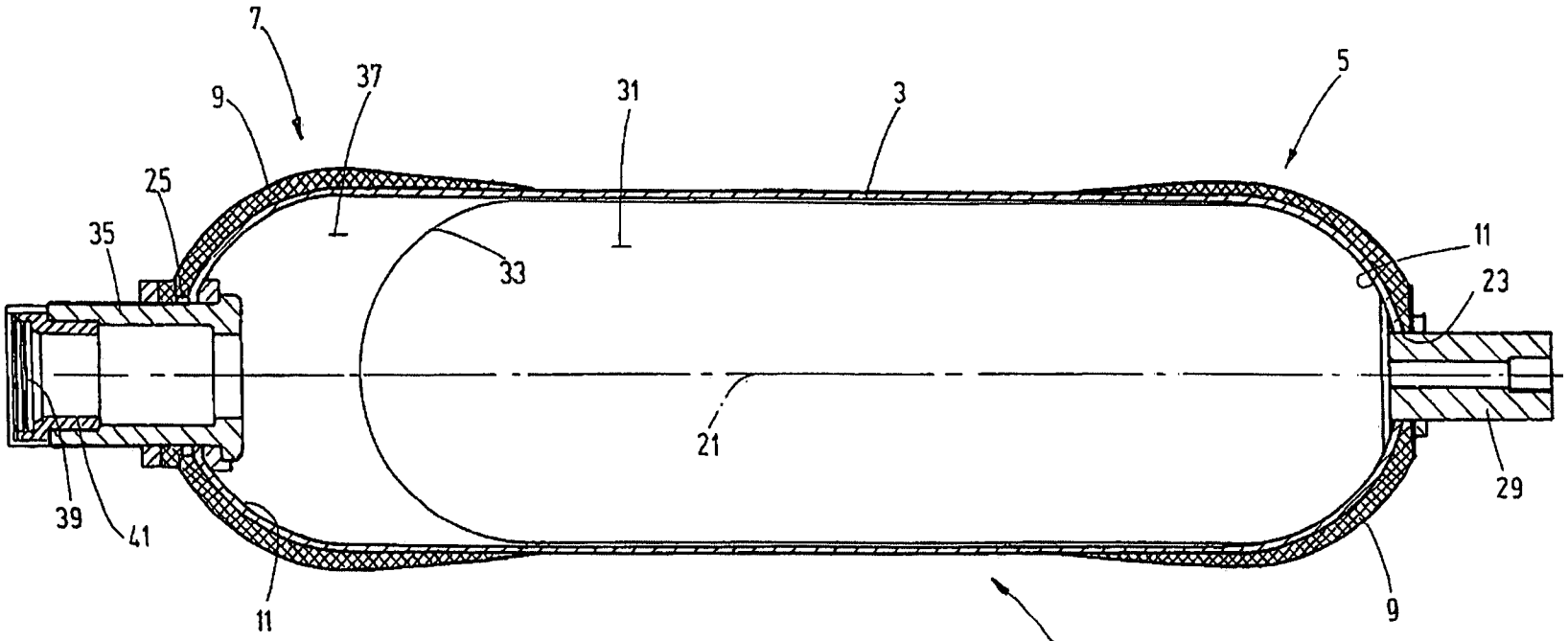
FIG. 2 is a schematic, not to scale, side elevational view in section of a bladder accumulator having the pressure vessel of FIG. 1.

FIG. 2 shows in a schematically simplified diagram a bladder accumulator having a vessel body 1 according to the exemplary embodiment shown in FIG. 1. As this drawing figure shows, a connecting part 29 forms a fluid connection to the inner chamber 31 of a conventional accumulator bladder 33 and is situated on the opening 23 having the smaller diameter. A connecting part 35 forms the fluid connection to the chamber 37 on the outside of the accumulator bladder 33 and is situated on the other opening 25 having the larger diameter. In a preferred application, the accumulator bladder 33 may form a movable separation element for media separation, for example, separating sea water in the chamber 37 from a water/glycol mixture in the inner chamber 31 of the accumulator bladder 33 when the bladder accumulator 27 is used in maritime facilities.

Figure 3:
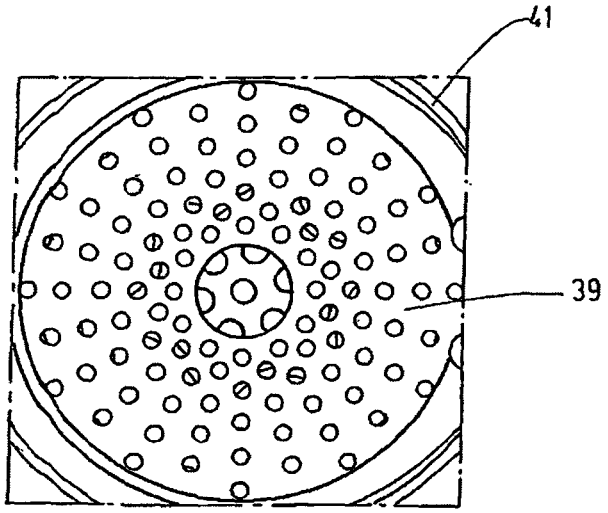
FIG. 3 is a partial top view of the sea water connecting part of the bladder accumulator of FIG. 2, shown in an enlarged scale.

The exemplary embodiment of a bladder accumulator 27 provided with the pressure vessel according to the invention, as shown in FIG. 2, the bladder accumulator being provided for maritime use has a sea water screen 39 on the connecting part 35 that forms the sea water access. This sea water screen is situated in a threaded insert 41 that can be screwed into the connecting part 35. FIG. 3 shows a detail of the threaded insert 41 with a view of the hole pattern of the sea water screen 39. The screen 39 is preferably made of an anodic material such as copper, which copper material functions as an electrolyte in combination with the sea water. The screen 39 then prevents not only the admission of living creatures or soiling to the chamber 37 of the bladder accumulator 27, but also forms protection against microorganisms.

While various embodiments have been chosen to illustrate the invention, it will become understood by those skilled in the art that various changes and modifications can be made therein without departing from the scope of the invention as defined in the appended claims.

What is claimed is:

1. A pressure vessel, comprising:

a multipart vessel body including a tubular central part with opposite first and second axial ends and including a first cap connected to said first axial end of said tubular central part and forming an additional component of said vessel body; and a first cover part surrounding an outside of said first cap and extending over said tubular central part only in a region of said tubular central part at said first axial end fixedly joining said tubular central part to said first cap, said first cover part including a first cover laminate, said first cap being bonded by an adhesive to said first axial end of said tubular central part.

2. A pressure vessel according to claim 1 wherein said tubular central part and said first cap are made of at least one of a fiber composite material or a laminate of fibers.

3. A pressure vessel according to claim 1 wherein said first cap has a hemispherical shape and a first opening being uncovered by said first cover laminate.

4. A pressure vessel according to claim 1 wherein said adhesive is a multicomponent adhesive.

5. A pressure vessel comprising:

a multipart vessel body including a tubular central part with opposite first and second axial ends and including a first end cap connected to said first axial end of said tubular central part, said multipart vessel body including an inner chamber having a plastic lining applied by at least one of a centrifugal sintering method or a rotational sintering method; and a first cover laminate surrounding an outside of said first end cap and extending over said tubular central part only in a region of the tubular central part at said first axial end fixedly joining said tubular central part to said first end cap, said first cap being bonded by an adhesive to said first axial end of said tubular central part.

6. A pressure vessel according to claim 1 wherein said multipart vessel body comprises a second cap on said second axial end of said tubular central part; and a second cover part surrounding an outside of said second cap and extending over said tubular central part only in a region thereof at said second axial end fixedly joining said tubular central part to said second cap.

7. A pressure vessel according to claim 6 wherein said second cover part comprises a second cover laminate.

8. A pressure vessel, comprising:

a multipart vessel body including a tubular central part with opposite first and second axial ends, including a first cap connected to said first axial end of said tubular central part and including a second cap connected to said second axial end of said tubular central part;

a first cover part surrounding an outside of said first end cap and extending over said tubular central part only in a region of the tubular central part at said first axial end fixedly joining said tubular central part to said first cap, said first cover part including a first cover laminate;

a second cover part surrounding an outside of said second cap and extending over said tubular central part only in a region thereof at said second axial end fixedly joining said tubular central part to said second cap, said second cover part including a second cover laminate;

said first and second caps having first and second openings, respectively; and said multipart vessel body including an inner chamber having an accumulator bladder therein separating said inner chamber into first and second chambers to form an accumulator bladder.

9. A pressure vessel according to claim 8 wherein said first opening comprises a sea water screen for admission of sea water into said first chamber.

10. A pressure vessel according to claim 9 wherein said second chamber has a water/glycol mixture therein separated from sea water in said first chamber in a maritime facility.

11. A pressure vessel according to claim 8 wherein said tubular central part and said first and second caps are made of at least one of a fiber composite material or a laminate of fibers.

12. A pressure vessel according to claim 8 wherein said first and second caps have hemispherical shapes and first and second openings being uncovered by said first and second cover laminates, respectively.

13. A pressure vessel according to claim 8 wherein said first and second caps are bonded by adhesive to said first and second axial ends, respectively, of said tubular central part.

14. A pressure vessel according to claim 13 wherein said adhesive is a multicomponent adhesive.

15. A pressure vessel according to claim 8 wherein said inner chamber has a plastic lining applied by at least one of a centrifugal sintering method or a rotational sintering method.

16. A pressure vessel according to claim 7 wherein said first and second cover parts having edges on said tubular central part facing and spaced from one another, with an outer surface of said tubular central part being exposed between said edges.

* * * * *